US005386675A

United States Patent [19]

Baur et al.

[11] Patent Number: 5,386,675

[45] Date of Patent: Feb. 7, 1995

[54] CONCRETE BEAM CONNECTION SLEEVE

[75] Inventors: Kenneth C. Baur; Thomas E. Keiser, both of Mohnton, Pa.

[73] Assignee: High Industries, Inc., Lancaster, Pa.

[21] Appl. No.: 87,643

[22] Filed: Jul. 12, 1993

[51] Int. Cl.[6] ..... E04B 1/41; E04G 17/00

[52] U.S. Cl. ..... 52/250; 52/223.13; 52/576; 52/577; 52/711

[58] Field of Search ..... 52/250–254, 52/285.2, 576, 577, 698, 703, 711, 584, 223.13, 704, 699, 732.1, 236.6, 236.9; 249/48, 175

[56] References Cited

U.S. PATENT DOCUMENTS

| | | | |
|---|---|---|---|
| 1,714,987 | 5/1929 | Pedersen | 52/250 X |
| 1,765,664 | 6/1930 | Flath | 52/584 X |
| 1,798,468 | 3/1931 | Hartzler et al. | 52/698 |
| 3,237,357 | 3/1966 | Hutchings | 52/253 X |
| 3,566,560 | 3/1971 | Wakefield et al. | 52/251 X |
| 3,703,748 | 11/1972 | Kelly | 52/223.13 X |
| 3,712,014 | 1/1973 | Waerner | 52/711 X |
| 3,733,757 | 5/1973 | Scott | 52/250 X |
| 3,762,027 | 10/1973 | Burtelson | 52/223.13 X |
| 4,141,190 | 2/1979 | Shimada | 52/711 |
| 4,368,606 | 1/1983 | Hoshino | 52/711 |

OTHER PUBLICATIONS

High Concrete Structures, Inc. "Exterior Spandrel/-Column" Drawing, Apr. 15, 1991.

*Primary Examiner*—Michael Safavi
*Assistant Examiner*—Robert J. Canfield
*Attorney, Agent, or Firm*—Thomas Hooker

[57] ABSTRACT

A concrete beam connector sleeve has a tubular plastic body with a large dimensional end portion, a funnel portion joining the end portion, a rod guide portion joining the funnel portion, a bolting step joining the rod guide portion and a large dimension portion at the end of the sleeve away from the opposite end of the sleeve. The sleeve is cast in a cement column with the large dimension portion opening into a spandrel-supporting recess and the other large dimension portion opening into the opposite side of the column. A threaded rod mounted in a spandrel seated in the recess extends through the interior of the sleeve and past the bolting step. A nut threaded onto the end of the rod secure the spandrel in place on the column.

22 Claims, 2 Drawing Sheets

CONCRETE BEAM CONNECTION SLEEVE

FIELD OF THE INVENTION

The field of the invention relates to systems and components for bolting together cast concrete beams, typically spandrels and columns.

DESCRIPTION OF THE PRIOR ART

Parking garages and other large structures are erected using precast concrete beams. Horizontally extending spandrels are secured to vertical columns. Bolt connections secure the spandrels in place in recesses formed in the columns. Typically, the recesses are formed in the outer wall of the columns. The spandrels rest on the lower surfaces of the recesses and are held in the recesses by threaded rods which engage mounting plates cast into the inner surfaces of the spandrels. The rods extend through the hollow cylindrical metal sleeves cast into the columns. Large diameter recesses are formed on the inner ends of the metal sleeves. Large specially manufactured washers are fitted into these recesses. The rod ends extend through the washers. Clamp and lock washers are fitted over the ends of the sleeves and nuts are then threaded onto the ends of the rods and tightened to engage the large washers, thereby securing the spandrels in place.

The metal sleeves are typically cylindrical having the same interior dimension along their length. Fitting the threaded rods mounted on the spandrels through the sleeves during placement of the spandrels into the recesses is difficult. The free ends of the rods must be piloted into the ends of the sleeves prior to flush placement of the spandrels in the recesses. Moving the free ends of the rods through the sleeves is also difficult, particularly when the rods ends engage the sleeves and must be pushed or slid along the sleeves and into the large diameter recess on the opposite surface of the column. This frictional engagement is inevitable because the spandrel is rotated into the recesses and the rotating straight rods must be fed through the cylindrical sleeves. The scraping engagement with the interior metal walls of the sleeves may on occasion deform the threads into the rods. Further, casting tolerances may locate the rods slightly out of alignment with the sleeves making it difficult to bend the rods as they are moved through the sleeves.

The conventional spandrel-to-column connection requires manufacture of specialized large washers which are seated in large openings in the column at the end of the sleeves away from the spandrel recesses. These washers are expensive to manufacture. Fitting of the large washers can be difficult, particularly if the threaded rods are bent during insertion of the spandrel into the column recesses. Additionally, it is difficult to form an attractive weather seal at the exposed end of the enlarged recess in the column.

SUMMARY OF THE INVENTION

The invention is a molded plastic concrete beam connector sleeve which is cast in concrete columns at a spandrel-receiving recess. The sleeve communicates the spandrel-receiving recess with the opposite side of the column. The lower ends of a spandrel with projecting threaded rods are seated in recesses in two adjacent columns. At the same time, the ends of the threaded rods are piloted into and extended through the interior of the sleeves. The sleeves have a large dimension rod receiving end portion opening into the spandrel recess in the column to facilitate initial piloting of the end of the rod into the sleeves as the spandrel is seated and rotated in the recesses. Funnel portions of the sleeves extend away from the enlarged ends to small dimension rod guide portions defining vertical slots opening into bolting steps in second large dimension portions of the sleeves opening on the sides of the column away from the spandrel recesses.

The plastic funnel portions guide the ends of the spandrel rods into and past the steps so that when the spandrel is fully seated in the recess the ends of the rods are located within the second large dimension portions of the sleeves a short distance below the side of the column. Conventional clamp washers and lock washers are then fitted over the ends of the threaded rods and nuts are threaded on the ends of the rods to clamp the rods against the sleeve shoulders. Tightening of the nuts secures the spandrel in the recesses. Removable caps close the exposed ends of the second large dimension portions of the sleeves.

Feeding of the threaded rods through the sleeves is facilitated by the tough low friction plastic in the sleeves, particularly as the ends of the rods are channeled by the funnel portions to the slots in the steps. This occurs as the spandrel is being rotated into the recess and may necessitate bending of the rods in order to extend the rods in place for being bolted to the columns.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
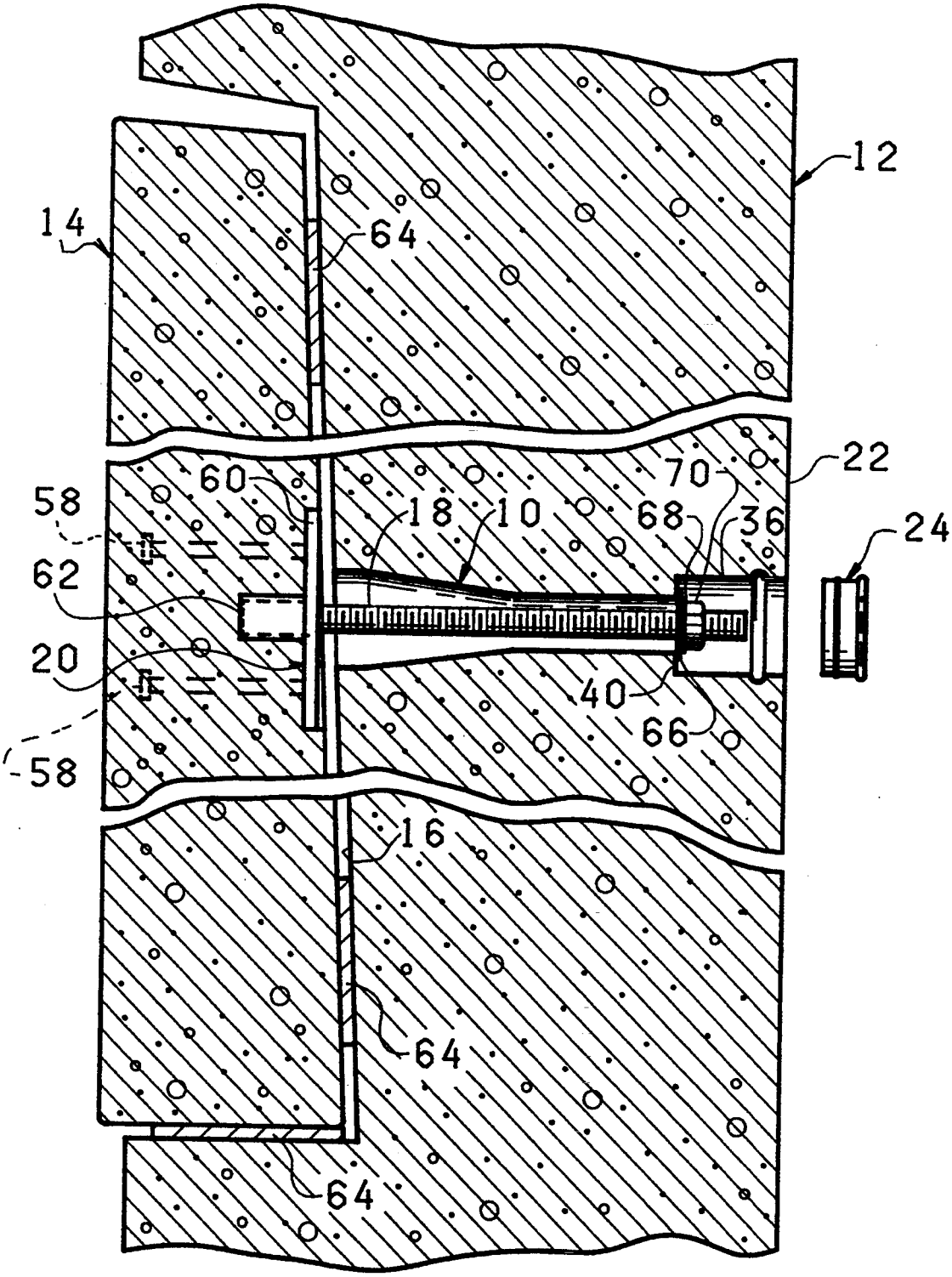
FIG. 1 is a vertical sectional view taken through the concrete column and supported spandrel showing a concrete beam connection sleeve according to the invention.

As illustrated in FIG. 1, concrete beam connection sleeve 10 is cast in vertical concrete column 12 and extends between spandrel recess 16 and the opposing side 22 of the column. An end of spandrel 14 is fitted within recess 16 and is secured in the recess by a threaded rod 18 which extends from an insert plate 20 cast in the end of the spandrel and a bolt connection between the free end of the rod and a step 40 formed in the sleeve adjacent side 22 of the column away from recess 16. A cap 24 is fitted in the open end of the sleeve at side 22 to seal the interior of the sleeve and improve the finish appearance of the column.

Figure 2:
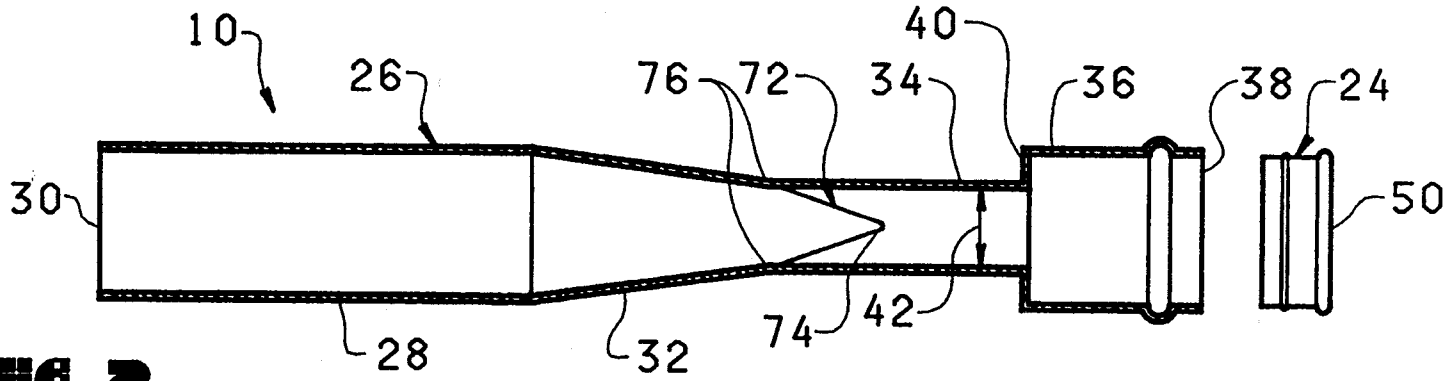
FIG. 2 is a vertical sectional view taken through the sleeve.
Figure 4:
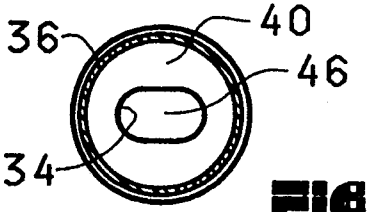
FIG. 4 is a sectional view taken along line 4—4 of FIG. 3.
Figure 3:
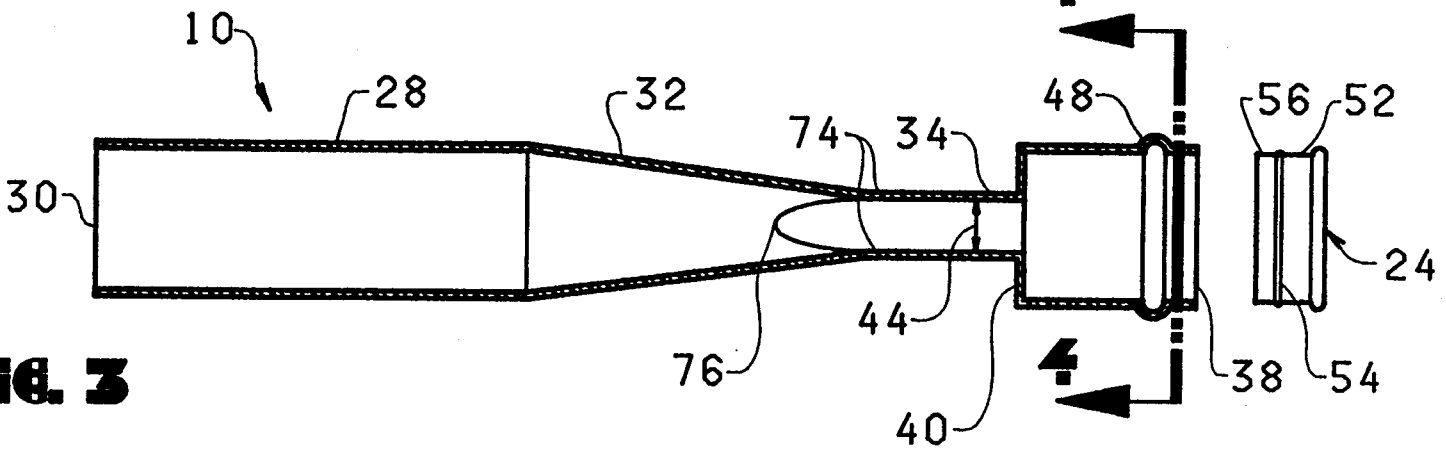
FIG. 3 is a horizontal sectional view taken through the sleeve.

FIGS. 2, 3 and 4 illustrate sleeve 10. The sleeve includes an elongate generally tubular plastic body 26 molded from a tough, low friction plastic, which may be polyethylene or other suitable plastic. The sleeve has an open ended hollow interior extending along the length of body 26. The sleeve is preferably manufactured by a blow molding process and appropriately trimmed after molding.

The integral plastic body 26 includes a large dimension cylindrical end portion 28 extending a distance inwardly from tube end 30 to an inwardly tapered funnel portion 32. The small dimension end of the funnel portion 32 away from body end 30 joins small dimension tubular rod guide portion 34. A large dimension cylindrical end portion 36 is located at end 38 of the body, opposite from portion 26, and joins the rod guide portion 34 at bolting step 40.

The interior height 42 of rod guide portion 34 is greater than the interior width 44 of the portion so that the portion defines a vertical interior opening or slot 46 shown in FIG. 4. Step 40 faces body end 38 and surrounds slot 46. A groove 48 extends around the interior surface of cylindrical portion 36 adjacent end 38.

The cap 24 is mold-formed from plastic material, which may be polyethylene, and includes a solid circular end face 50 and a cylindrical collar 52 extending to one side of the circumference of the end face. Outwardly projecting ridge 54 extends around collar 52. As illustrated, the diameter of the collar is less than the diameter of the end face and is essentially equal to the interior diameter of cylindrical portion 36. The outer end 56 of collar 52 may be inwardly tapered in order to facilitate insertion of the collar into the open end of portion 36. The cap is snap-fitted into the end of portion 36 with ridge 54 extending into the groove 48 and the circumferential edge of the end face 50 resting on end 38 of the sleeve body.

The concrete beam connector sleeve 10 is used to secure an end of a spandrel 14 in recess 16 of cast concrete column 12. Typically, a pair of sleeves 10 are cast side by side at the same height in column 12 opposite recess 16 and are used to secure the ends of a pair of spandrels in the recess. The two spandrels extend in opposite directions away from the column and are fitted within the recess. FIG. 1 of the drawings illustrates the connection used to secure the end of one spandrel 14 to column 12.

During casting of the column 12 a sleeve 10 shown in FIGS. 2–4 is fitted in the column mold at a proper location adjacent to the mold part defining recess 16. Part of the end portion 28 may be trimmed from body 26 so that the body has appropriate length equal to the width of the column at the recess. In this way, the sleeve 10 may be adjusted in length for use in different thickness columns, as required. With the proper length sleeve mounted in place in the mold for column 10, the column is cast leaving the interior of the sleeve hollow.

Spandrels 14 are conventionally cast with ferrule insert plates 20 in place at the ends of the spandrels at suitable locations for securing the spandrels to columns. The insert plates 20 include anchor members 58 extending into the body of the spandrel and a flat metal plate 60 with a hollow threaded sleeve 62 extending into the body of the spandrel. Prior to erecting the spandrel on supporting columns, rods 18 are threaded into sleeves 62.

As illustrated in FIGS. 2 and 3, the funnel portion 32 of sleeve 10 joins the rod guide portion 34 at an intersection 72 extending completely around the circumference of the sleeve 10. The funnel portion extends into the flat sides of the rod guide portion 34 to ends 74 located adjacent step 40. The ends 76 of rod guide portion at the top and bottom of the portion extend into the funnel portion and are located further away from step 40 than ends 74. The intersection 72 includes four U-shaped sections extending around the circumference of the sleeve with apexes at ends 74 and 76.

Spandrel 14 is mounted on a pair of erected columns 12 in recesses 16 by elevating the spandrel and placing the bottoms of the ends of the spandrel in the column recesses and then rotating the spandrel into the recesses. Bearing pads 64 are positioned between the spandrel and the column. During this mounting, the free ends of threaded rods 18 are easily piloted into the large dimension ends of the sleeves 10 opening into the recesses 16. Rotation of the spandrels into the recesses extends the rods 18 through the interiors of the sleeves so that the free ends project beyond steps 40 within large dimension tubular portions 36 as illustrated.

During this operation, the free ends of the rods engage the interior sides of the sleeves. The tough low friction interior walls of plastic bodies 26 guide the ends of the rods through the body, into rod guide portion and past steps 40 without damaging the threads.

During casting of columns 12, the sleeves 10 are positioned within the mold so that the slots 46 are oriented vertically when columns 12 are erected, thereby permitting free vertical movement of the rod during insertion while limiting lateral movement of the rods. In this way, the sleeves assure that the ends of the rods extend past steps 40 during rotation and possible bending of the rods as the spandrel is properly mounted within recesses 16.

With the ends of the spandrel held in place in recesses 16 of adjacent columns and the free ends of rods 18 in portions 36 beyond the step, conventional circular clamp washers 66 are fitted over the ends of the rods and seated against steps 40. Lock washers 68 are placed on top of clamp washers 66 and then nuts 70 are threaded onto the ends of the rods and tightened down to hold washers 66 against the steps and thereby secure the ends of the spandrel within recesses 16. Each end of the spandrel 14 is secured to a vertical column 12 in recesses 16 as illustrated.

Following forming of the threaded connections securing the spandrel to the columns, caps 24 are inserted into the open ends of portions 36 to close the portions from weather and form an aesthetically pleasing finish surface on column sides 22. If desired, a suitable caulking material may be applied to the outer surfaces of collars 52 to form water impervious seals between the collars and sleeve portions 36.

Caps 24 may be removed from sleeve portions 36 to allow adjustment of the connections holding spandrel 14 in place. Additionally, removal of the caps permits unthreading of nuts 70 to free spandrel 14 from its supporting columns in the event it is necessary to mount a different spandrel on the columns. Typically, this occurs when the columns and spandrels form part of a automotive parking structure and the structure is expanded using spandrels of greater length than the original spandrels.

While we have illustrated and described a preferred embodiment of our invention, it is understood that this is capable of modification, and we therefore do not wish to be limited to the precise details set forth, but desire to avail ourselves of such changes and alterations as fall within the scope of the following claims.

What we claim as our invention is:

1. A concrete beam connection sleeve comprising an elongate one-piece tubular plastic body having a hollow interior extending along the length of the body open at each end, said body including:

A) a circumferential funnel portion having a large dimension end and a small dimension end;

B) a circumferential first large dimension portion joined to the small dimension end of the funnel portion; and C) a bolting step located between the first large dimension portion and the funnel portion and facing the first large dimension portion, an opening in said step, said opening communicating the interior of the funnel portion and the interior of the first large dimension portion.

2. A sleeve as in claim 1 wherein the body includes a circumferential second large dimension portion joining the large dimension end of the funnel portion.

3. A sleeve as in claim 2 wherein both large dimension portions are cylindrical.

4. A sleeve as in claim 2 wherein the body includes a circumferential small dimension rod guide portion joining the small dimension end of the funnel portion and the step at the opening.

5. A sleeve as in claim 4 wherein the opening is a slot.

6. A sleeve as in claim 5 wherein said body is formed from polyethylene plastic.

7. A sleeve as in claim 1 wherein the opening is a slot.

8. A sleeve as in claim 7 wherein the body includes a circumferential small dimension rod guide portion joining the small dimension end of the funnel portion and the bolting step at the slot.

9. A sleeve as in claim 1 which includes an intersection between the rod guide portion and the funnel portion comprising a number of U-shaped sections extending around the circumference of the sleeve.

10. A sleeve as in claim 9 wherein said intersection includes a first pair of apexes adjacent one end of the sleeve and a second pair of apexes adjacent the other end of the sleeve.

11. The combination of a sleeve as in claim 1 and a plastic cap for closing the first large dimension portion.

12. The combination of claim 11 including a thin interior circumferential recess extending around the first large dimension portion, and wherein the cap includes an end face, a circumferential collar adapted to fit within said first large dimension portion and a member projecting outwardly of the collar engagable with said recess.

13. A structure comprising:

A) a vertical concrete column having a spandrel recess formed in one column side and an opposite column side away from the spandrel recess;

B) a hollow plastic connection sleeve cast in the column, said sleeve communicating the spandrel recess and the opposite column side and including a hollow integral plastic body having a bolting step facing the opposite column side, and a funnel portion located between the bolting step and the spandrel recess, the funnel portion having a first large dimension end adjacent the spandrel recess and a second small dimension end adjacent the bolting step;

C) a cast concrete spandrel fitted in said spandrel recess;

D) a threaded rod having a first end secured in the spandrel, said rod extending from the spandrel through the interior of the connection sleeve to a second end located within the sleeve between the step and the opposite column side; and E) connection means for engaging the treads on the second end of the threaded rod and the bolting step to thereby secure the spandrel within the recess.

14. A structure as in claim 13 including a slot in the step surrounding the threaded rod.

15. A structure as in claim 14 wherein the funnel portion includes a large dimension end located a distance from the spandrel recess.

16. A structure as in claim 13 including a plastic cap closing the end of the sleeve at the opposite column side.

17. A structure as in claim 13 wherein said connection means comprises a nut engaging the threads on the second end of the threaded rod and a washer confined between the nut and the bolting step.

18. A structure as in claim 13 wherein said sleeve includes a second large dimension end joining the large dimension end of the funnel portion.

19. A structure as in claim 14 wherein said sleeve includes a small diameter portion joining the small dimension end of the funnel portion and the edge of the bolting step.

20. A structure as in claim 16 wherein the sleeve includes a circumferential recess around the interior of the end of the sleeve at the opposite column side and the cap includes a circumferential collar engagable with said recess.

21. A structure as in claim 19 wherein the sleeve includes an intersection between the funnel portion and the small diameter portion which comprises a number of U-shaped sections extending around the circumference of the sleeve.

22. A structure as in claim 21 wherein the sleeve intersection includes a first pair of apexes and a second pair of apexes adjacent a second end of the sleeve.

* * * * *

UNITED STATES PATENT AND TRADEMARK OFFICE

CERTIFICATE OF CORRECTION

PATENT NO. : 5,386,675

DATED : FEBRUARY 7, 1995

INVENTOR(S) : KENNETH C. BAUR, ET AL

It is certified that error appears in the above-indentified patent and that said Letters Patent is hereby corrected as shown below:

Column 6, line 34, delete "14" and insert --13--.

Signed and Sealed this

Twenty-third Day of May, 1995

*Attest:*

Bruce Lehman

BRUCE LEHMAN

*Attesting Officer*

*Commissioner of Patents and Trademarks*